US008171917B2

(12) United States Patent
Di Domizio et al.

(10) Patent No.: US 8,171,917 B2
(45) Date of Patent: May 8, 2012

(54) COUPLING DEVICE

(75) Inventors: Gisella Di Domizio, San Giuliano Terme (IT); Daniel Marc, Leghorn (IT); Giandomenico Serra, Loc.Ghezzano-S.Giuliano Terme (IT)

(73) Assignee: Continental Automotive GmbH, Hannover (DE)

( * ) Notice: Subject to any disclaimer, the term of this patent is extended or adjusted under 35 U.S.C. 154(b) by 113 days.

(21) Appl. No.: 12/758,941

(22) Filed: Apr. 13, 2010

(65) Prior Publication Data

US 2010/0264231 A1 Oct. 21, 2010

(30) Foreign Application Priority Data

Apr. 15, 2009 (EP) ..... 09005396

(51) Int. Cl.
*F02M 61/14* (2006.01)
*F02M 61/16* (2006.01)

(52) U.S. Cl. ..... 123/470; 123/456

(58) Field of Classification Search ..... 123/470, 123/468, 469, 456, 447; 239/600; 138/26, 138/30

See application file for complete search history.

(56) References Cited

U.S. PATENT DOCUMENTS

| | | | | |
|---|---|---|---|---|
| 3,323,726 | A * | 6/1967 | Heintz | 239/533.11 |
| 4,901,700 | A * | 2/1990 | Knight et al. | 123/470 |
| 5,735,247 | A * | 4/1998 | Tsuzuki et al. | 123/470 |
| 6,338,333 | B1 | 1/2002 | Brosseau et al. | 123/456 |
| 7,188,611 | B2 * | 3/2007 | Schmieder | 123/469 |
| 2008/0216798 | A1 * | 9/2008 | Ghelardi et al. | 123/470 |
| 2008/0302336 | A1 | 12/2008 | Fuerst et al. | 123/470 |

FOREIGN PATENT DOCUMENTS

| | | |
|---|---|---|
| EP | 1094217 | 4/2001 |
| EP | 1862666 | 12/2007 |
| EP | 1967728 | 9/2008 |
| JP | 2000297723 | 10/2000 |

OTHER PUBLICATIONS

European Search Report and Written Opinion for Application No. 09005396.8 (8 pages), Sep. 21, 2009.

European Search Report and Written Opinion for Application No. 09005322.4 (7 pages), Sep. 21, 2009.

* cited by examiner

*Primary Examiner* — Mahmoud Gimie
(74) *Attorney, Agent, or Firm* — King & Spalding L.L.P.

(57) ABSTRACT

A coupling device for hydraulically and mechanically coupling an injection valve to a fuel rail of a combustion engine, has a fuel injector cup with a central longitudinal axis which can be hydraulically coupled to the fuel rail and at least partially engaged with the fuel inlet tube. The cup has an inner bottom surface facing the valve, a first retaining element fixedly coupled to the cup, a second retaining element fixedly coupled to the valve, wherein the second retaining element is coupled to the first element to prevent a movement of the second element relative to the first element in a first axis direction, and a damper element which is arranged axially between the inner bottom surface of the cup and the inlet tube. The damper element limits a movement of the valve relative to the cup in a second direction of the longitudinal axis opposing the first direction.

20 Claims, 3 Drawing Sheets

COUPLING DEVICE

CROSS-REFERENCE TO RELATED APPLICATIONS

This application claims priority to EP Patent Application No. 09005396 filed Apr. 15, 2009, the contents of which is incorporated herein by reference in its entirety.

TECHNICAL FIELD

The invention relates to a coupling device for hydraulically and mechanically coupling a fuel injector to a fuel rail of a combustion engine.

BACKGROUND

Coupling devices for hydraulically and mechanically coupling a fuel injector to a fuel rail are in widespread use, in particular for internal combustion engines. Fuel can be supplied to an internal combustion engine by the fuel rail assembly through the fuel injector. The fuel injectors can be coupled to the fuel injector cups in different manners.

In order to keep pressure fluctuations during the operation of the internal combustion engine at a very low level, internal combustion engines are supplied with a fuel accumulator to which the fuel injectors are connected and which has a relatively large volume. Such a fuel accumulator is often referred to as a common rail.

Known fuel rails comprise a hollow body with recesses in form of fuel injector cups, wherein the fuel injectors are arranged. The connection of the fuel injectors to the fuel injector cups that supply the fuel from a fuel tank via a low or high-pressure fuel pump needs to be very precise to get a correct injection angle and a sealing of the fuel.

SUMMARY

According to various embodiments, a coupling device can be created for hydraulically and mechanically coupling a fuel injector to a fuel rail which is simply to be manufactured and which facilitates a reliable and precise connection between the fuel injector and the fuel injector cup without a resting of the fuel injector on the cylinder head.

According to an embodiment, a coupling device for hydraulically and mechanically coupling an injection valve to a fuel rail of a combustion engine, wherein the injection valve has a valve body and a fuel inlet tube being partially arranged in the valve body, may comprise:—a fuel injector cup having a central longitudinal axis and being designed to be hydraulically coupled to the fuel rail and at least partially being in engagement with the fuel inlet tube, the fuel injector cup comprising an inner bottom surface facing the injection valve, —a first retaining element being fixedly coupled to the fuel injector cup, a second retaining element being fixedly coupled to the injection valve, the second retaining element being coupled to the first retaining element to prevent a movement of the second retaining element relative to the first retaining element in a first direction of the central longitudinal axis to retain the injection valve in the fuel injector cup, and —a damper element being arranged axially between the inner bottom surface of the fuel injector cup and the fuel inlet tube and being designed to limit a movement of the injection valve relative to the fuel injector cup in a second direction of the central longitudinal axis opposing the first direction. According to a further embodiment, the damper element can be an elastic distance element. According to a further embodiment, the fuel inlet tube may have an end surface facing the inner bottom surface, and the damper element can be arranged axially between the inner bottom surface and the end surface. According to a further embodiment, a washer can be arranged at an axial end of the fuel inlet tube, and the damper element is arranged axially between the inner bottom surface and the washer. According to a further embodiment, the damper element can be shaped as a ring. According to a further embodiment, the square section of the damper element in axial direction may have a rectangular shape. According to a further embodiment, the damper element can be of a material which comprises a rubber.

BRIEF DESCRIPTION OF THE DRAWINGS

Exemplary embodiments are explained in the following with the aid of schematic drawings. These are as follows.

Elements of the same design and function that occur in different illustrations are identified by the same reference character.

DETAILED DESCRIPTION

Figure 1:
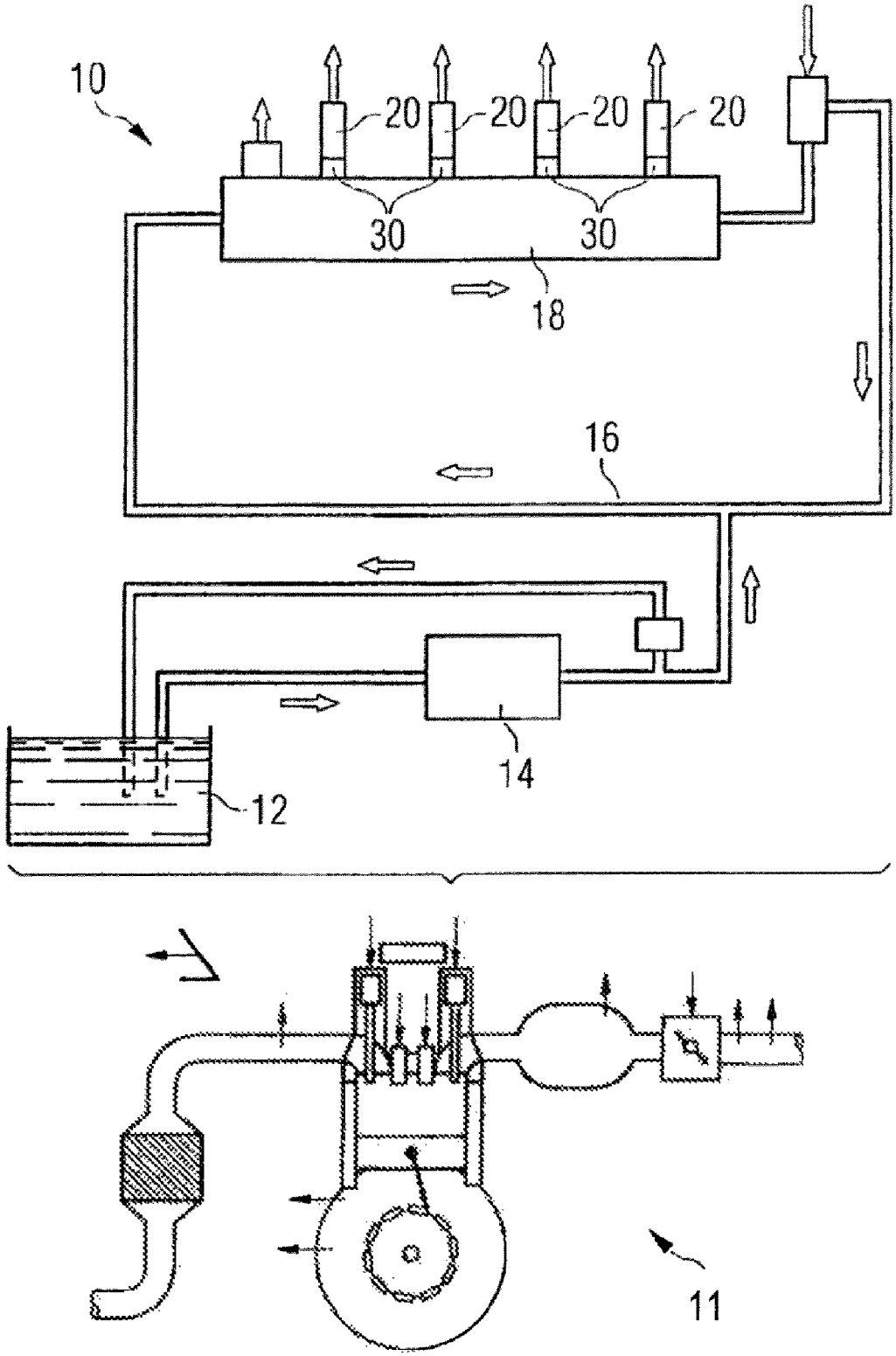
FIG. 1 an internal combustion engine in a schematic view.

According to various embodiments, a coupling device is proposed for hydraulically and mechanically coupling a fuel injector to a fuel rail of a combustion engine. The injection valve comprises a valve body and a fuel inlet tube being partially arranged in the valve body. The coupling device comprises a fuel injector cup having a central longitudinal axis and is designed to be hydraulically coupled to the fuel rail and is at least partially in engagement with the fuel inlet tube. The fuel injector cup comprises an inner bottom surface facing the injection valve. The coupling device comprises a first retaining element being fixedly coupled to the fuel injector cup, a second retaining element being fixedly coupled to the injection valve, the second retaining element being coupled to the first retaining element to prevent a movement of the second retaining element relative to the first retaining element in a first direction of the central longitudinal axis to retain the injection valve in the fuel injector cup, and a damper element. The damper element is arranged axially between the inner bottom surface of the fuel injector cup and the fuel inlet tube and is designed to limit a movement of the injection valve relative to the fuel injector cup in a second direction of the central longitudinal axis opposing the first direction.

This has the advantage that only a little movement of the injection valve towards the injector cup is possible. The counterforce of the damper element is proportional to the axial deviation of the injection valve referring to a neutral rest position of the injection valve relative to the injector cup. Furthermore, the noise due to a contact between the injection valve and the injector cup can be kept small. The mounting and assembly of the fuel rail can be carried out in a simple manner.

In an embodiment the damper element is an elastic distance element. This has the advantage that the rest position of the injection valve relative to the injector cup can be adjusted very exactly.

In a further embodiment the fuel inlet tube has an end surface facing the inner bottom surface. The damper element is arranged axially between the inner bottom surface and the end surface. This has the advantage that a robust arrangement of the damper element can be obtained.

In a further embodiment a washer is arranged at an axial end of the fuel inlet tube, and the damper element is arranged axially between the inner bottom surface and the washer.

In a further embodiment the damper element is shaped as a ring. This may allow a good coupling of the damper element with the fuel injector cup and the fuel inlet tube possible. Furthermore, a simple design of the damper element is possible. Additionally, a long lifetime of the damper element is possible. No further components beside the damper element are necessary.

In a further embodiment the square section of the damper element in axial direction has a rectangular shape. By this a good coupling of the damper element with the fuel injector cup and the fuel inlet tube and/or the washer is possible.

In a further embodiment the damper element is of a material which comprises a rubber. Rubber has good mechanical properties in particular in view of elasticity and the lifetime of the damper element.

A fuel feed device 10 is assigned to an internal combustion engine 11 (FIG. 1) which can be a diesel engine or a gasoline engine. It includes a fuel tank 12 that is connected via a first fuel line to a fuel pump 14. The output of the fuel pump 14 is connected to a fuel inlet 16 of a fuel rail 18. In the fuel rail 18, the fuel is stored for example under a pressure of about 200 bar in the case of a gasoline engine or of about more than 2,000 bar in the case of a diesel engine. Fuel injectors 20 are connected to the fuel rail 18 and the fuel is fed to the fuel injectors 20 via the fuel rail 18.

Figure 2:
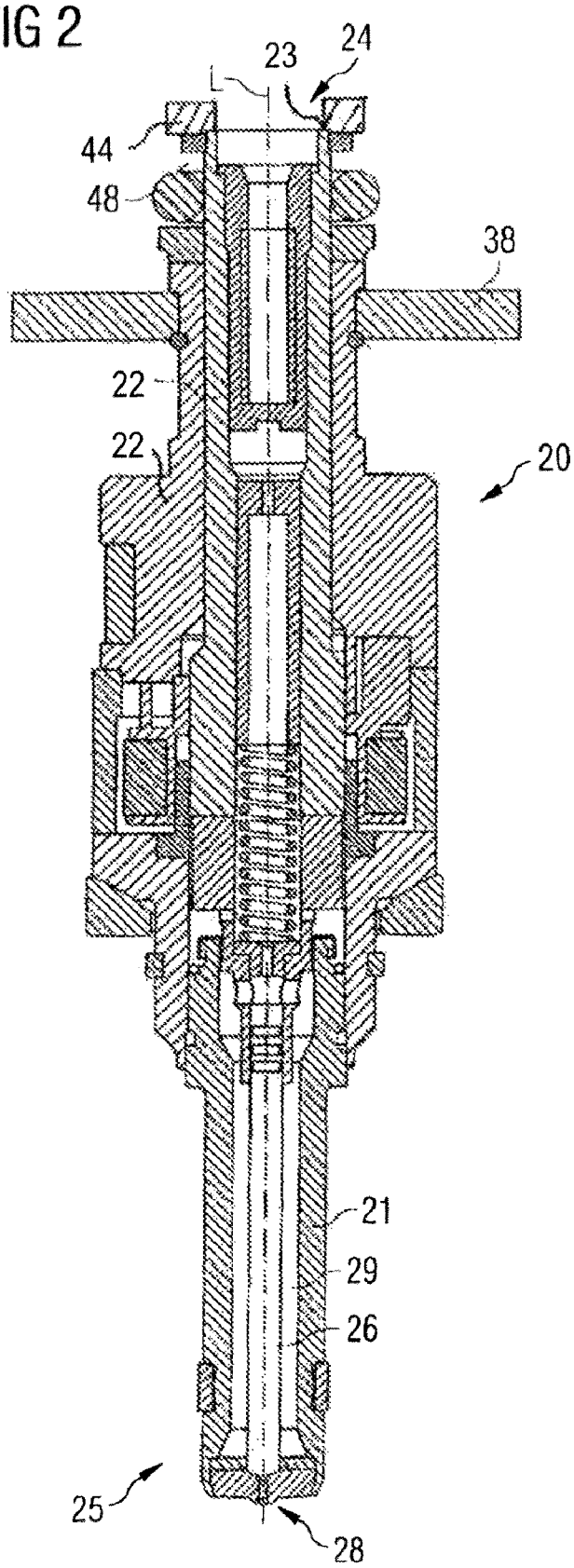
FIG. 2 a longitudinal section through a fuel injector.

FIG. 2 shows the fuel injector 20 in detail. The fuel injector 20 is suitable for injecting fuel into a combustion chamber of the internal combustion engine 11. The fuel injector 20 comprises a central longitudinal axis L and has a valve body 21. Inside the valve body 21 a fuel inlet tube 22 is arranged partially. The fuel inlet tube 22 has an end surface 23 and comprises a fuel inlet portion 24 of the fuel injector 20. Furthermore, the fuel injector 20 has a fuel outlet portion 25.

The fuel injector 20 comprises a valve needle 26 taken in a cavity 29 of the valve body 21. On a free end of the fuel injector 20 an injection nozzle 28 is formed which is closed or opened depending on the position of the valve needle 26 due to an axial movement of the valve needle 26. In a closing position of the valve needle 26 a fuel flow through the injection nozzle 28 is prevented. In an opening position fuel can flow through the injection nozzle 28 into a combustion chamber of the internal combustion engine 11.

Figure 3:
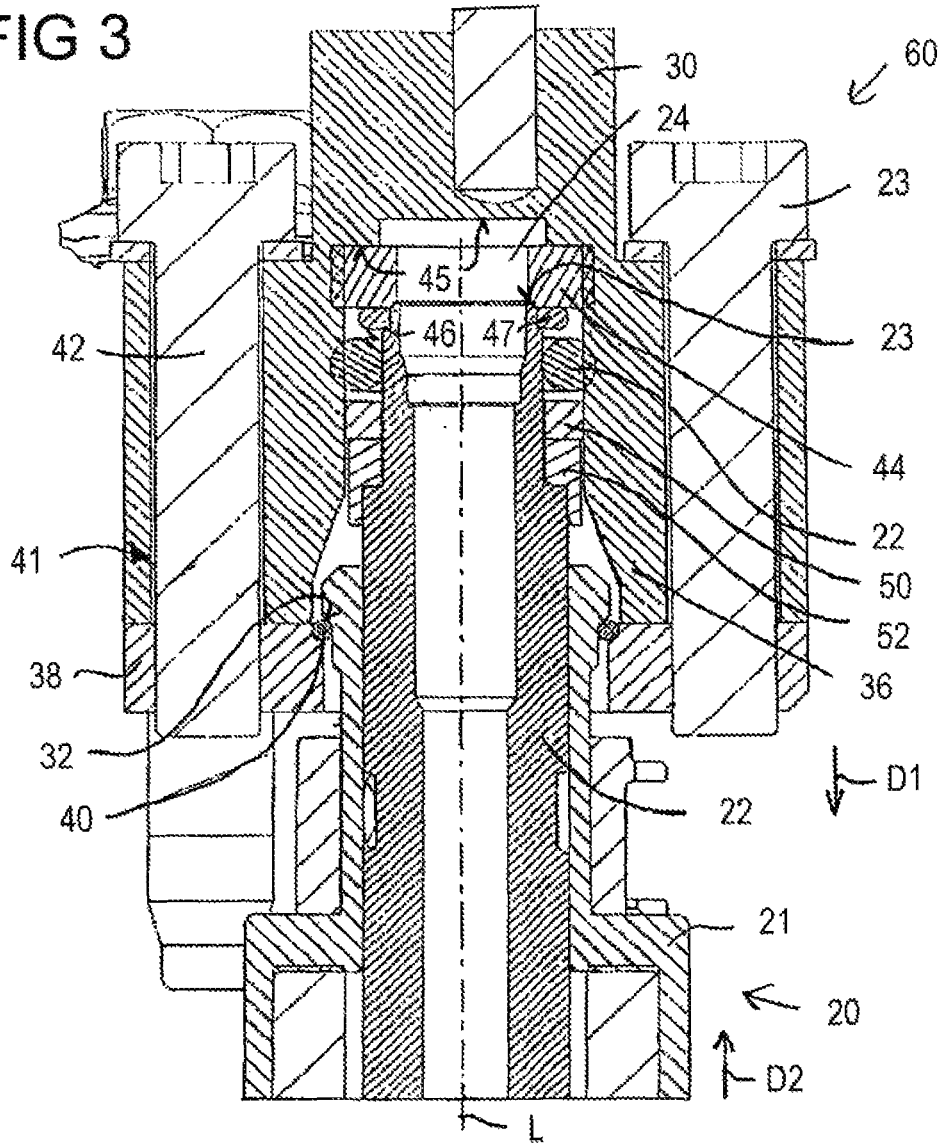
FIG. 3 a longitudinal section through a first embodiment of a coupling device, and FIG. 4 a longitudinal section through a detail of a second embodiment of the coupling device.
Figure 4:
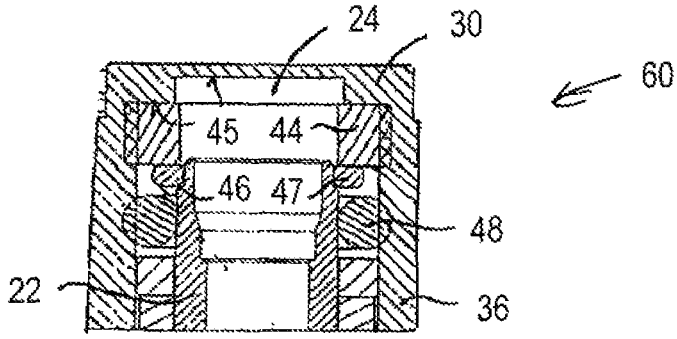

FIGS. 3 and 4 show different embodiments of a coupling device 60 which is coupled to the fuel rail 18 of the internal combustion engine 11. The fuel injector 20 has a groove 32. The coupling device 60 comprises a fuel injector cup 30, a first retaining element 36 and a second retaining element 38, a snap ring 40 arranged in the groove 32, at least a screw 42 and a damper element 44, the parts of the coupling device 60 being described in the following.

The fuel injector cup 30 is hydraulically coupled to the fuel rail 18. The fuel injector cup 30 has an inner surface comprising an inner bottom surface 45. Furthermore, the fuel injector cup 30 is in engagement with the fuel inlet tube 22 of the fuel injector 20.

The fuel inlet tube 22 has a step 46 at an axial end of the fuel inlet tube 22 facing the inner bottom surface 45. A washer 47 is arranged at the step 46.

On an outer surface of the fuel inlet tube 22 a sealing ring 48 is arranged which is in sealing contact with the inner surface of the fuel injector cup 30. Additionally, a backup ring 50 and a backup ring support 52 are arranged radially between the outer surface of the fuel inlet tube 22 and the fuel injector cup 30.

The first retaining element 36 is in one piece with the fuel injector cup 30. In further embodiments the first retaining element 36 can be a separate part which is fixedly coupled to the fuel injector cup 30.

The second retaining element 38 is in engagement with the snap ring 40 which is arranged in the groove 32 of the fuel injector 20. The snap ring 40 enables a positive fitting coupling between the second retaining element 38 and the fuel injector 20. Consequently, the second retaining element 38 is fixedly coupled to the fuel injector 20.

Preferably, the first retaining element 36 may have a through hole 41. The first retaining element 36 and the second retaining element 38 are fixedly coupled with each other by the screw 42 which is received by the through hole 41 of the first retaining element 36 and is screwed into the second retaining element 38. This prevents a movement of the second retaining element 38 relative to the first retaining element 36 in a first direction D1.

The positive fitting coupling between the second retaining element 38 and the fuel injector 20 prevents a movement of the fuel injector 20 relative to the second retaining element 38 in the first direction D1.

As the first retaining element 36 is fixedly coupled to the fuel injector cup 30, the second retaining element 38 is fixedly coupled to the fuel injector 20 and the first retaining element 36 is fixedly coupled to the second retaining element 38, the fuel injector 20 is retained in the fuel injector cup 30 in direction of the central longitudinal axis L. This arrangement is also named a suspended fuel injector.

The damper element 44 is arranged axially between the fuel injector cup 30 and the injection valve 20. The damper element 44 is in radial interference with the injector cup 30. The damper element 44 is an elastic distance element. An axial interference with the injector cup 30 is avoided to enable an exact positioning of the injection valve 20 relative to the fuel injector cup 30.

Preferably, the damper element 44 may comprise a rubber which has good mechanical properties in view of elasticity. Furthermore, the lifetime of the damper element 44 comprising a rubber is very high.

Preferably, the damper element 44 may have the shape of a ring. In an embodiment, the square section of the damper element 44 in axial direction is of a rectangular shape. This enables a good contact of the damper element 44 with the fuel injector cup 30 and the fuel inlet tube 22 and/or the washer 47. In further embodiments, the square section of the damper element 44 in axial direction has a circular or an elliptic shape.

As shown in FIG. 3, the damper element 44 is arranged axially between the inner bottom surface 45 of the fuel injector cup 30 and both the fuel inlet tube 22 and the washer 47.

In the embodiment of FIG. 4 the damper element 44 of the coupling device 60 shaped as a ring has an inner diameter larger than in the embodiment of FIG. 3. By this the damper element 44 is arranged axially between the inner bottom surface 45 of the fuel injector cup 30 and the washer 47 only, and a direct contact with the fuel inlet tube 22 is avoided.

The damper element 44 limits the movement of the injection valve 20 relative to the fuel injector cup 30 in a second direction D2 of the central longitudinal axis L. The first direction D1 and the second direction D2 are opposing directions of the central longitudinal axis L. By this, only a small movement of the injection valve 20 in the second direction D2 towards the inner bottom surface 45 of the fuel injector cup 30 is possible.

The counterforce of the damper element 44 is proportional to the axial deviation of the injection valve 20 referring to a neutral rest position of the injection valve 20 relative to the fuel injector cup 30. Therefore, an elastic control of the axial movement of the injection valve 20 relative to the fuel injector cup 30 is possible. The injection valve 20 can be kept easily in its neutral rest position relative to the fuel injector cup 30 even in the case that the pressure in the combustion chamber is higher than the fuel pressure in the fuel rail 18.

As suspended injection valves are constructed in view of a low noise development, it can be very advantageous that the damper element 44 can avoid a direct contact between the injection valve 20 and the injector cup 30. Consequently, the noise due to the contact between the injection valve 20 and the fuel injector cup 30 can be kept small.

Additionally, the mounting and the assembly of the fuel rail can be carried out in a secure manner as the damper element 44 holds the valve body 21 in a close contact with the snap ring 40 as well as the snap ring 40 in a close contact with the second retaining element 38 due to the compression effect caused by the damper element 44.

What is claimed is:

1. A coupling device for hydraulically and mechanically coupling an injection valve to a fuel rail of a combustion engine, wherein the injection valve has a valve body and a fuel inlet tube being partially arranged in the valve body, the coupling device comprising:

a fuel injector cup having a central longitudinal axis and being designed to be hydraulically coupled to the fuel rail and at least partially being in engagement with the fuel inlet tube, the fuel injector cup comprising an inner bottom surface located beyond the axial end of the fuel inlet tube in an upstream direction of fuel flow and facing the injection valve, a first retaining element being fixedly coupled to the fuel injector cup, a second retaining element being fixedly coupled to the injection valve, the second retaining element being coupled to the first retaining element to prevent a movement of the second retaining element relative to the first retaining element in a first direction of the central longitudinal axis, the second retaining element physically preventing a movement of the injection valve in the first direction to retain the injection valve in the fuel injector cup, and a damper element being arranged axially between an axial end of the fuel inlet tube and the inner bottom surface of the fuel injector cup located beyond the axial end of the fuel inlet tube in the upstream direction of fuel flow, the damper element being designed to limit a movement of the injection valve relative to the fuel injector cup in a second direction of the central longitudinal axis opposing the first direction.

2. The coupling device according to claim 1, wherein the damper element is an elastic distance element.

3. The coupling device according to claim 1, wherein the fuel inlet tube has an end surface facing the inner bottom surface, and the damper element is arranged axially between the inner bottom surface and the end surface.

4. The coupling device according to claim 1, wherein a washer is arranged at an axial end of the fuel inlet tube, and the damper element is arranged axially between the inner bottom surface and the washer.

5. The coupling device according to claim 1, wherein the damper element is shaped as a ring.

6. The coupling device according to claim 5, wherein the square section of the damper element in axial direction has a rectangular shape.

7. The coupling device according to claim 1, wherein the damper element is of a material which comprises a rubber.

8. A coupling device for hydraulically and mechanically coupling an injection valve to a fuel rail of a combustion engine, the coupling device comprising:

a fuel injector cup having a central longitudinal axis and being at least partially in engagement with a fuel inlet tube of the injection valve, the fuel inlet tube being partially arranged in a valve body, wherein the fuel injector cup comprises an inner bottom surface located beyond the axial end of the fuel inlet tube in an upstream direction of fuel flow and facing the injection valve, a first retaining element being fixedly coupled to the fuel injector cup, a second retaining element being fixedly coupled to the injection valve, the second retaining element being coupled to the first retaining element to prevent a movement of the second retaining element relative to the first retaining element in a first direction of the central longitudinal axis, the second retaining element physically preventing a movement of the injection valve in the first direction to retain the injection valve in the fuel injector cup, and a damper element being arranged axially between an axial end of the fuel inlet tube and the inner bottom surface of the fuel injector cup located beyond the axial end of the fuel inlet tube in the upstream direction of fuel flow, the damper element being designed to limit a movement of the injection valve relative to the fuel injector cup in a second direction of the central longitudinal axis opposing the first direction.

9. The coupling device according to claim 8, wherein the damper element is an elastic distance element.

10. The coupling device according to claim 8, wherein the fuel inlet tube has an end surface facing the inner bottom surface, and the damper element is arranged axially between the inner bottom surface and the end surface.

11. The coupling device according to claim 8, wherein a washer is arranged at an axial end of the fuel inlet tube, and the damper element is arranged axially between the inner bottom surface and the washer.

12. The coupling device according to claim 8, wherein the damper element is shaped as a ring.

13. The coupling device according to claim 12, wherein the square section of the damper element in axial direction has a rectangular shape.

14. The coupling device according to claim 8, wherein the damper element is of a material which comprises a rubber.

15. A method for hydraulically and mechanically coupling an injection valve to a fuel rail of a combustion engine, wherein the injection valve has a valve body and a fuel inlet tube being partially arranged in the valve body, the method comprising the steps of:

providing a fuel injector cup having a central longitudinal axis and being designed to be hydraulically coupled to the fuel rail and at least partially being in engagement with the fuel inlet tube, the fuel injector cup comprising an inner bottom surface located beyond the axial end of the fuel inlet tube in an upstream direction of fuel flow and facing the injection valve, coupling a first retaining element fixedly to the fuel injector cup, and a second retaining element fixedly coupled to the injection valve, wherein the second retaining element being coupled to the first retaining element to prevent a movement of the second retaining element relative to the first retaining element in a first direction of the central longitudinal axis, the second retaining element physically preventing a movement of the injection valve in the first direction to retain the injection valve in the fuel injector cup, and arranging a damper element axially between an axial end of the fuel inlet tube and the inner bottom surface of the fuel injector cup located beyond the axial end of the fuel inlet tube in the upstream direction of fuel flow, the damper element limiting a movement of the injection valve relative to the fuel injector cup in a second direction of the central longitudinal axis opposing the first direction.

16. The method according to claim 15, wherein the damper element is an elastic distance element.

17. The method according to claim 15, wherein the fuel inlet tube has an end surface facing the inner bottom surface, and the damper element is arranged axially between the inner bottom surface and the end surface.

18. The method according to claim 15, further comprising arranging a washer at an axial end of the fuel inlet tube, and arranging the damper element axially between the inner bottom surface and the washer.

19. The method according to claim 15, wherein the damper element is shaped as a ring and wherein the square section of the damper element in axial direction has a rectangular shape.

20. The method according to claim 15, wherein the damper element is of a material which comprises a rubber.

* * * * *